US008276721B2

(12) United States Patent
Nordstrom

(10) Patent No.: US 8,276,721 B2
(45) Date of Patent: Oct. 2, 2012

(54) COLLAPSIBLE BAGGAGE AND METHOD OF COLLAPSING AND EXPANDING A BAGGAGE

(76) Inventor: Mark Nordstrom, Brentwood, TN (US)

( * ) Notice: Subject to any disclaimer, the term of this patent is extended or adjusted under 35 U.S.C. 154(b) by 452 days.

(21) Appl. No.: 12/476,064

(22) Filed: Jun. 1, 2009

(65) Prior Publication Data

US 2010/0300825 A1 Dec. 2, 2010

(51) Int. Cl.
*A45C 7/00* (2006.01)

(52) U.S. Cl. ..... 190/107; 190/103; 190/104; 190/18 A; 220/8; 383/39

(58) Field of Classification Search ..... 190/107, 190/100, 104, 103, 18 A; 220/8; 383/39
See application file for complete search history.

(56) References Cited

U.S. PATENT DOCUMENTS

| | | | | |
|---|---|---|---|---|
| 2,538,616 | A * | 1/1951 | Cross | 190/107 |
| 2,710,084 | A * | 6/1955 | Braverman | 190/107 |
| 2,728,426 | A | 12/1955 | Dobyns | |
| 2,806,563 | A * | 9/1957 | Einhorn | 190/107 |
| 4,953,673 | A | 9/1990 | Ambasz | |
| 5,197,580 | A | 3/1993 | Berman et al. | |
| 5,400,494 | A | 3/1995 | Stilley | |
| 5,749,446 | A | 5/1998 | Hsieh | |
| 6,021,874 | A | 2/2000 | Nykoluk | |
| 6,220,411 | B1 | 4/2001 | Scicluna et al. | |
| 7,175,010 | B1 | 2/2007 | Miner | |
| 7,273,139 | B2 | 9/2007 | Lantz | |
| 7,281,616 | B2 | 10/2007 | Peterson et al. | |
| 2002/0185350 | A1 | 12/2002 | Chang et al. | |

FOREIGN PATENT DOCUMENTS

| | | | |
|---|---|---|---|
| GB | 580953 | A | 9/1946 |
| GB | 587841 | A | 5/1947 |

OTHER PUBLICATIONS

International Search Report and Written Opinion for PCT/US2010/035237 issued Jul. 20, 2010.

* cited by examiner

*Primary Examiner* — Anthony Stashick
*Assistant Examiner* — Cynthia Collado
(74) *Attorney, Agent, or Firm* — Thompson Coburn LLP

(57) ABSTRACT

A collapsible baggage comprises structural side assemblies. The structural side assemblies comprise a plurality of interconnected panel members. When the baggage is expanded, the panel members of each side assembly are generally in plane with each other and are able to prevent the baggage from collapsing under load. The panel members can pivot relative to each other in a manner allowing the baggage to collapse.

14 Claims, 9 Drawing Sheets

COLLAPSIBLE BAGGAGE AND METHOD OF COLLAPSING AND EXPANDING A BAGGAGE

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention pertains to collapsible baggage and methods of collapsing and expanding baggage. More particularly, this invention pertains to structural components of baggage that can be reconfigured between expanded and collapsed configurations in a manner such that the baggage can be collapsed when not in use and such that the baggage have structural integrity when in use.

2. General Background

Most people prefer their travel baggage to be fairly rigid so as to minimize the wrinkling of clothes placed therein and to provide protection for the contents. However, in general, rigid baggage takes up just as much space when not in use as it does in use. Thus, there is a need for collapsible baggage that are also structurally rigid when expanded for use. As such, various attempts to address these issues have resulted in numerous baggage designs that comprise some form of selectively collapsible structure. An example of such a baggage is described in U.S. Pat. No. 2,710,084. An issue pertaining to such baggage is that they are not sufficiently strong when expanded to avoid being damaged when handled by modern automated airport luggage transfer systems. Additionally, many prior art collapsible baggage are not sufficiently easy to collapse and expand, and in some configurations the structural components hinder or interfere with the accessibility of the interior of the baggage.

SUMMARY OF THE INVENTION

The present invention provides for a selectively collapsible baggage that is generally rigid when expanded and that can be selectively collapsed and expanded with little effort. When expanded, the baggage has ample structural integrity sufficient to prevent the baggage and its contents from being damaged when handled by modern automated airport luggage transfer systems.

In one aspect of the invention, a collapsible baggage comprises a structural side assembly. The structural side assembly comprises first, second, and third rigid panel members. The first panel member is connected to the third panel member via the second panel member. The first panel member is pivotally connected to the second panel member about a first pivot axis, and the third panel member is pivotally connected to the second panel member about a second pivot axis. The side assembly is adjustable between collapsed and expanded configurations. The first, second, and third panel members are substantially in plane with each other when the side assembly is in the expanded configuration. When the side assembly is in the collapsed configuration, the first and third panel members are closer to each other.

In another aspect of the invention, a method comprises adjusting a collapsible baggage. The collapsible baggage comprises a structural side assembly having first, second, and third rigid panel members. The first panel member is connected to the third panel member via the second panel member. The first panel member is pivotally connected to the second panel member about a first pivot axis, and the third panel member is pivotally connected to the second panel member about a second pivot axis. The side assembly is adjustable between collapsed and expanded configurations. The first, second, and third panel members are substantially in plane with each other when the side assembly is in the expanded configuration. When the side assembly is in the collapsed configuration, the first and third panel members are closer to each other. The method of adjusting of the baggage alters the side assembly from the expanded configuration to the collapsed configuration.

In yet another aspect of the invention, a method comprises adjusting a collapsible baggage. The collapsible baggage comprises a structural side assembly and a pair of rigid perimeter rings. The side assembly connects one of the perimeter rings to the other of the perimeter rings and is adjustable between collapsed and expanded configurations. The perimeter rings are positioned a first distance apart from each other when the side assembly is in the expanded configuration and are a second distance apart when the side assembly is in the collapsed configuration. The first distance is greater than the second distance. The side assembly comprises a locking member that is biased from an unlocking position toward a locking position. The locking member inhibits the side assembly from adjusting from the expanded configuration to the collapsed configuration when the locking member is in the locking position, the adjusting of the baggage comprises forcibly retaining the locking member in the unlocking position while simultaneously adjusting the side assembly out of the expanded configuration.

In still another aspect of the invention, a method comprises adjusting a collapsible baggage. The collapsible baggage comprises a structural side assembly, a pair of rigid perimeter rings, and a handle. The side assembly connects one of the perimeter rings to the other of the perimeter rings and is adjustable between collapsed and expanded configurations. The perimeter rings are positioned a first distance apart from each other when the side assembly is in the expanded configuration and are a second distance apart when the side assembly is in the collapsed configuration. The first distance is greater than the second distance. The handle is rigidly attached to the side assembly. The side assembly comprises a locking member that is movable between an unlocking position and a locking position. The locking member inhibits the side assembly from adjusting from the expanded configuration to the collapsed configuration when the locking member is in the locking position. The adjusting of the baggage comprises pulling the handle in a manner that adjusts the side assembly into the expanded configuration. The pulling of the handle causes the locking member to move from the unlocking position to the locking position.

Further features and advantages of the present invention, as well as the operation of various embodiments of the present invention, are described in detail below with reference to the accompanying drawings.

Figure 1:
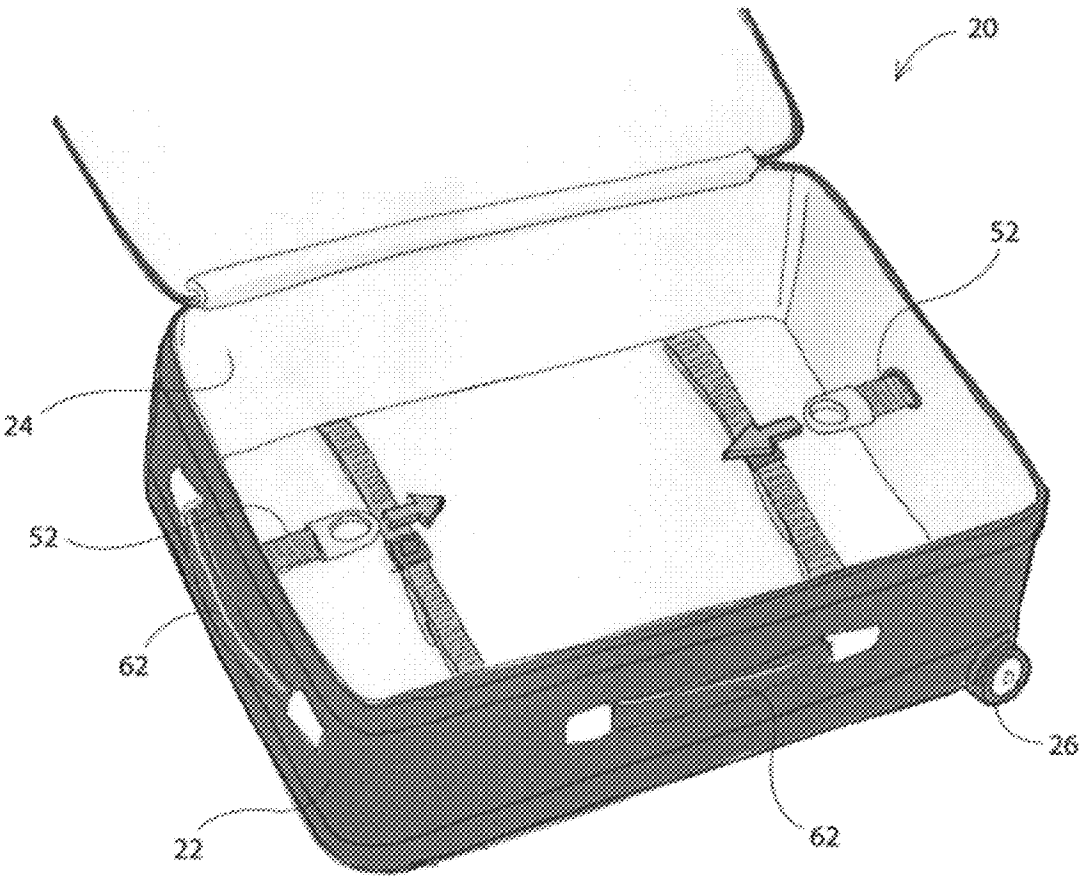
FIG. 1 is a perspective view of the preferred embodiment of a collapsible baggage accordance with the invention, and is shown in its expanded configuration.

Reference numerals in the written specification and in the drawing figures indicate corresponding items.

DETAILED DESCRIPTION OF THE PREFERRED EMBODIMENTS

Figure 2:
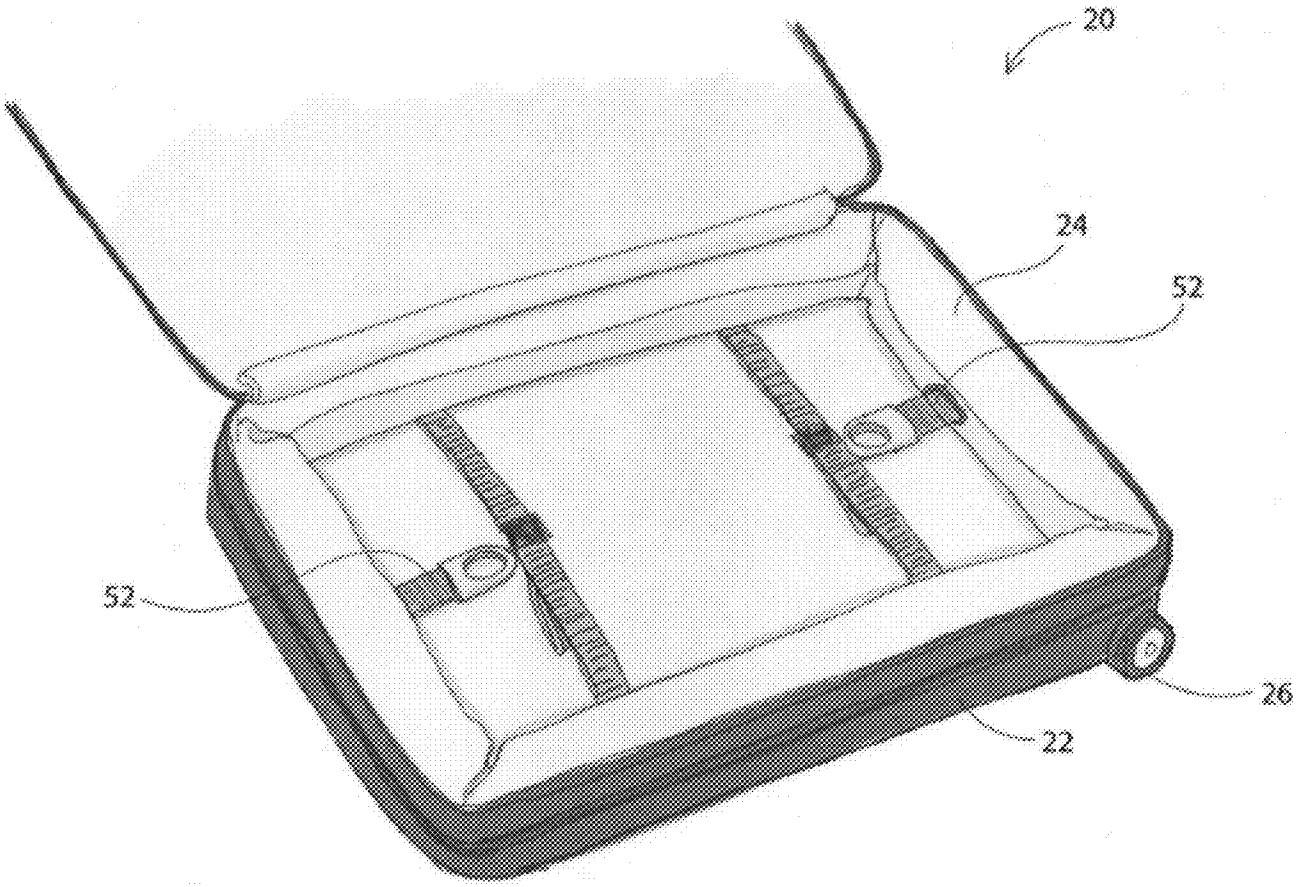
FIG. 2 is a perspective view of the baggage shown in FIG. 1 and is shown in its collapsed configuration.

The preferred embodiment of a baggage in accordance with the invention is shown in its entirety in FIGS. 1 and 2. The baggage 20 is shown in its expanded configuration in FIG. 1 and its collapsed configuration in FIG. 2. The baggage 20 preferably comprises a flexible outer shell 22 and a flexible inner liner 24 that are formed of materials commonly used on travel baggage. Furthermore, the baggage 20 comprises a pair of wheels 26 attached to one edge of the baggage and a telescopic towing handle assembly 28 for towing the baggage along the ground. Still further, the baggage 20 comprises various interconnected structural members that are sandwiched between the outer shell 22 and inner liner 24.

Figure 3:
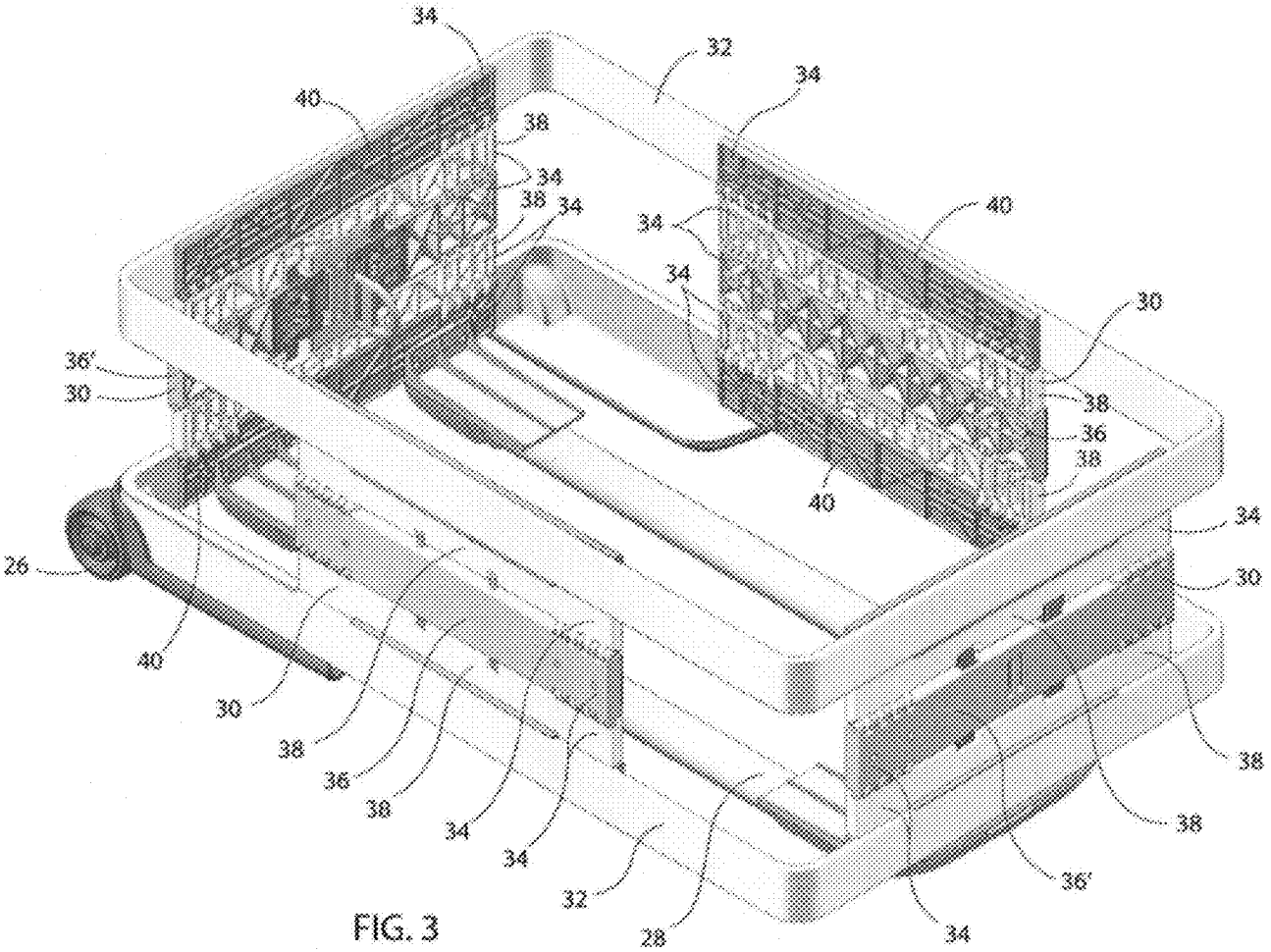
FIG. 3 is a perspective view of the structural components of the baggage shown in FIGS. 1 and 2 and is shown with the baggage and side assemblies in their expanded configurations.

The interconnected structural members are shown in FIGS. 3-9 and include structural side assemblies 30 and a pair of rigid perimeter rings 32. The side assemblies 30 and the perimeter rings 32 are preferably molded out of plastic. The perimeter rings 32 are preferably generally rectangular in shape with rounded corners. Preferably there are four side assemblies 30 that each connect the perimeter rings 32 to each other, with one adjacent each of the fours sides of the perimeter rings (as is shown in FIG. 3). Each side assembly 30 is preferably identical to the side assembly on the opposite side of the baggage 20. However, one pair of the side assemblies 30 is preferably slightly different from the other pair, as is discussed below.

Figure 4:
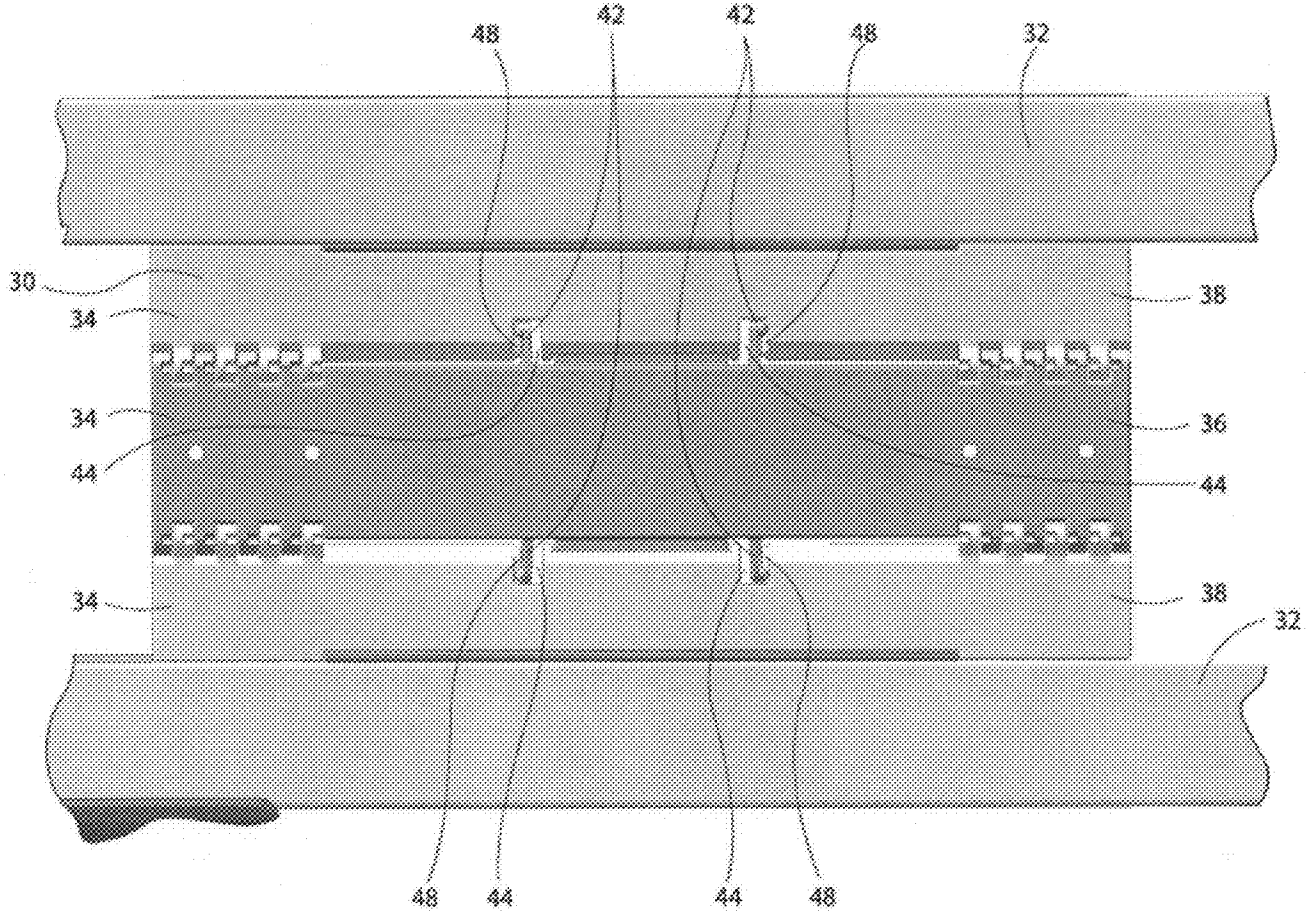
FIG. 4 is a side elevation view of one of the side assemblies of the baggage shown in FIGS. 1 and 2 and is shown in its expanded configuration.
Figure 7:
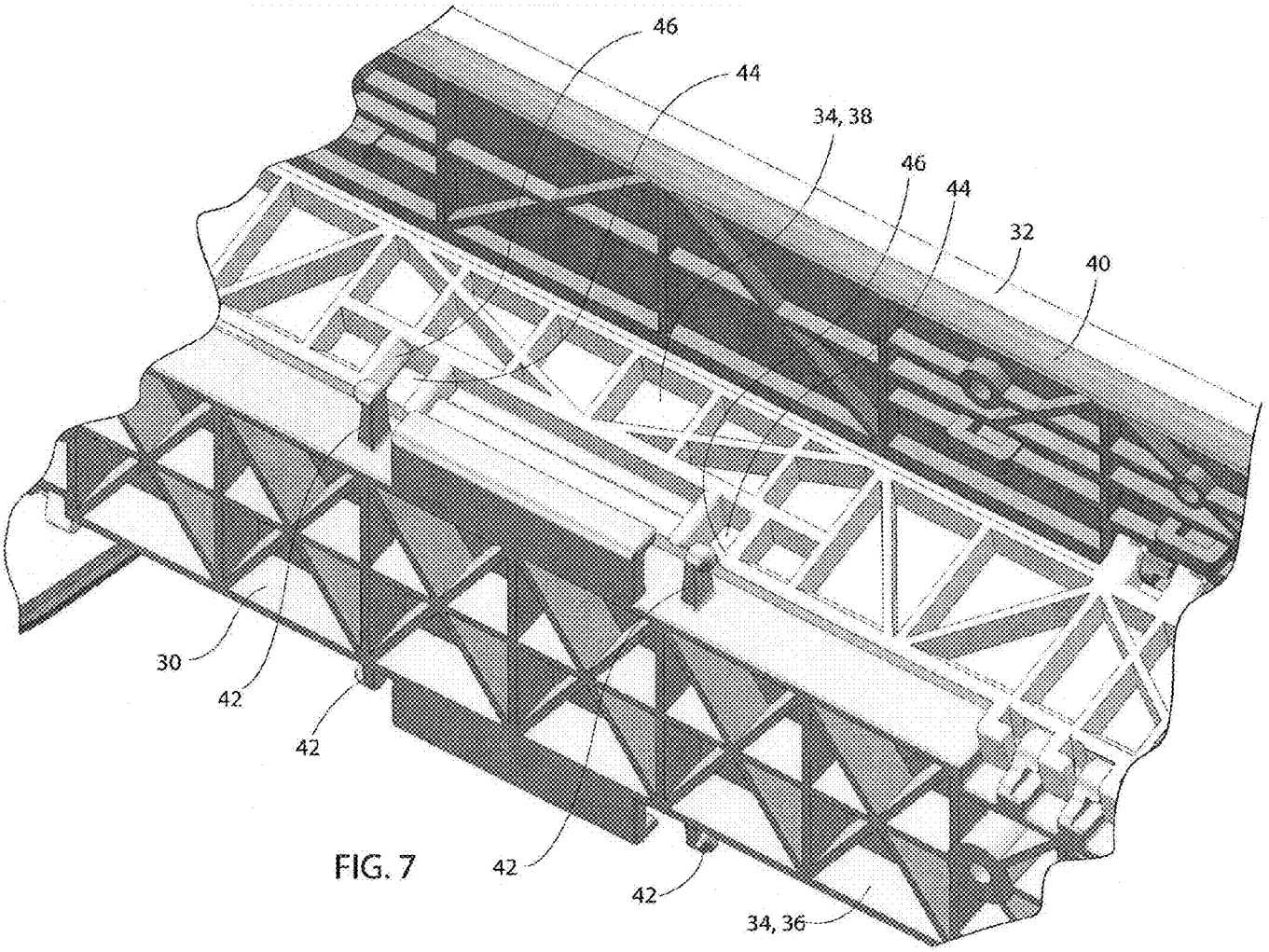
FIG. 7 is a detail perspective view of the side assembly shown in FIG. 4 and is shown between its expanded and collapsed configurations.

The side assemblies 30 shown along the longer sides of the baggage 20 preferably each comprise five rigid panel members 34 that are pivotally hinged to each other in a manner forming a chain of panel members. Preferably the hinges are similar to piano hinges for carrying shear loads across the hinges (the hinge pins are not shown in the drawings but are preferably standard hinge pins). Detail views of these side assemblies 30 are shown in FIGS. 4 and 7. The five panel members 34 of these side assemblies 30 comprise a center panel 36, two intermediate panels 38, and two end panels 40. Each of the end panels 40 is rigidly fixed to one of the perimeter rings 32 using fasteners such as rivets or an adhesive. The intermediate panels 38 connect the center panel 36 to each of the end panels 40 as shown. In the expanded configuration, the five panel members 34 lie generally in-plane with each other and are therefore capable of transmitting a significant amount of compressive load from one of the perimeter rings 32 to the next. In the collapsed configuration the center panel 36 of each side assembly 30 moves toward the center of the baggage 20 and the intermediate 38 panels pivot in a manner causing the perimeter rings 32 to move toward each other. As shown in FIGS. 4 and 7, these side assemblies 30 also comprise a plurality of resilient detent elements 42. The detent elements 42 protrude from the center panel 36 and are configured to cooperate with receptacles 44 that are provided in the intermediate panels 38. The receptacles 44 each comprise a camming surface 46 that is configured to engage with and resiliently deflect the detent elements 42 as the side assembly 30 is adjusted into its expanded configuration. When the side assembly 30 is in its expanded configuration, each of the detent elements is disengage with the respective camming surface 46 and is on the opposite side of the respective intermediate panel 38. As such, the detent elements 42 resiliently return to their original undeflected configuration when the side assembly 30 is in its expanded configuration, where a lip 48 adjacent each of the receptacles 44 opposite the camming surface 46 then impedes the respective detent element from passing back over to the opposite side of the intermediate panel 38. This locks the side assembly 30 in its expanded configuration in a manner requiring the application of a torque in excess of a threshold torque between the center panel 36 and each intermediate panel 38 in order to move the side assembly out of its expanded configuration. The torque can be applied by simply pushing the center panel 36 toward the center of the baggage. Once such a threshold torque is applied, the detent elements 42 will resiliently deflect and move past the lips 48 and eventually completely out of engagement with the intermediate panels 38.

Figure 5:
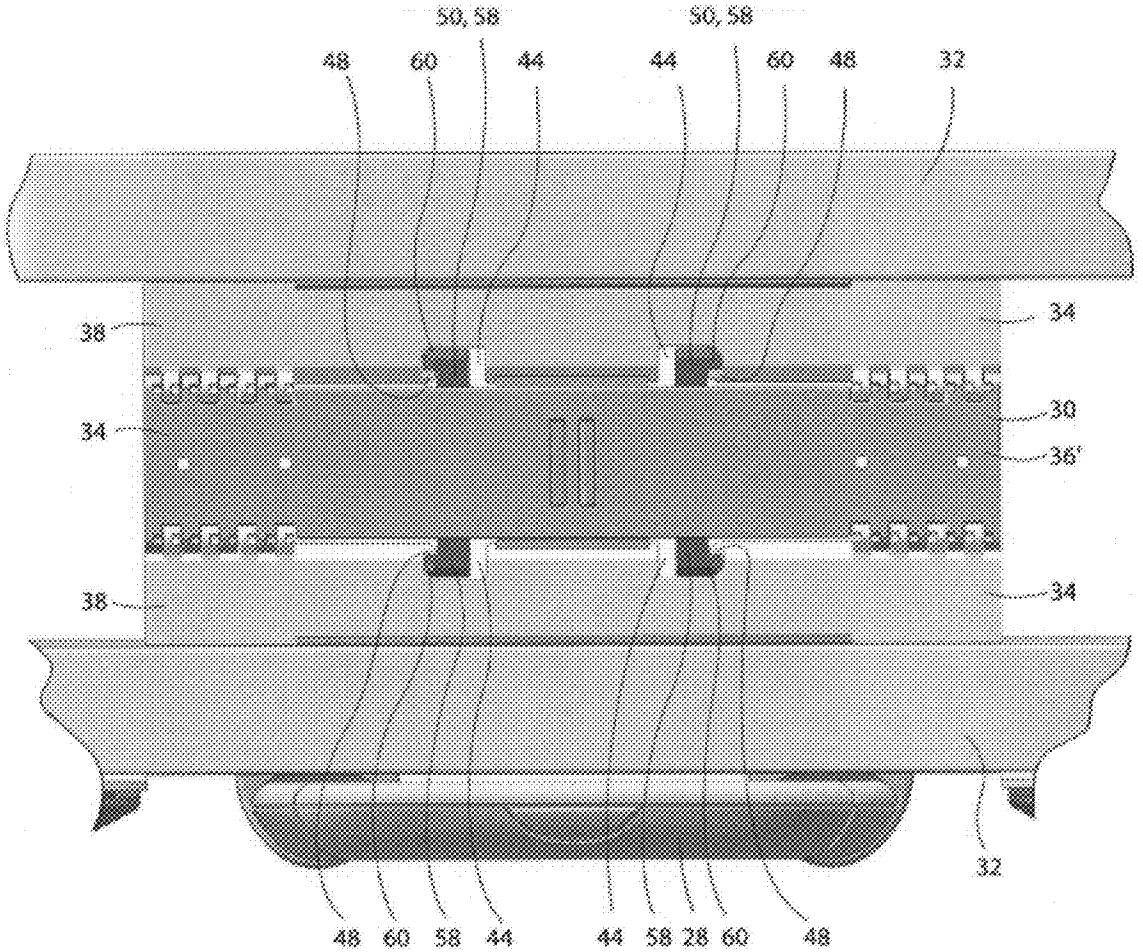
FIG. 5 is a side elevation view of another one of the side assemblies of the baggage shown in FIGS. 1 and 2 and is shown in its expanded configuration.
Figure 6:
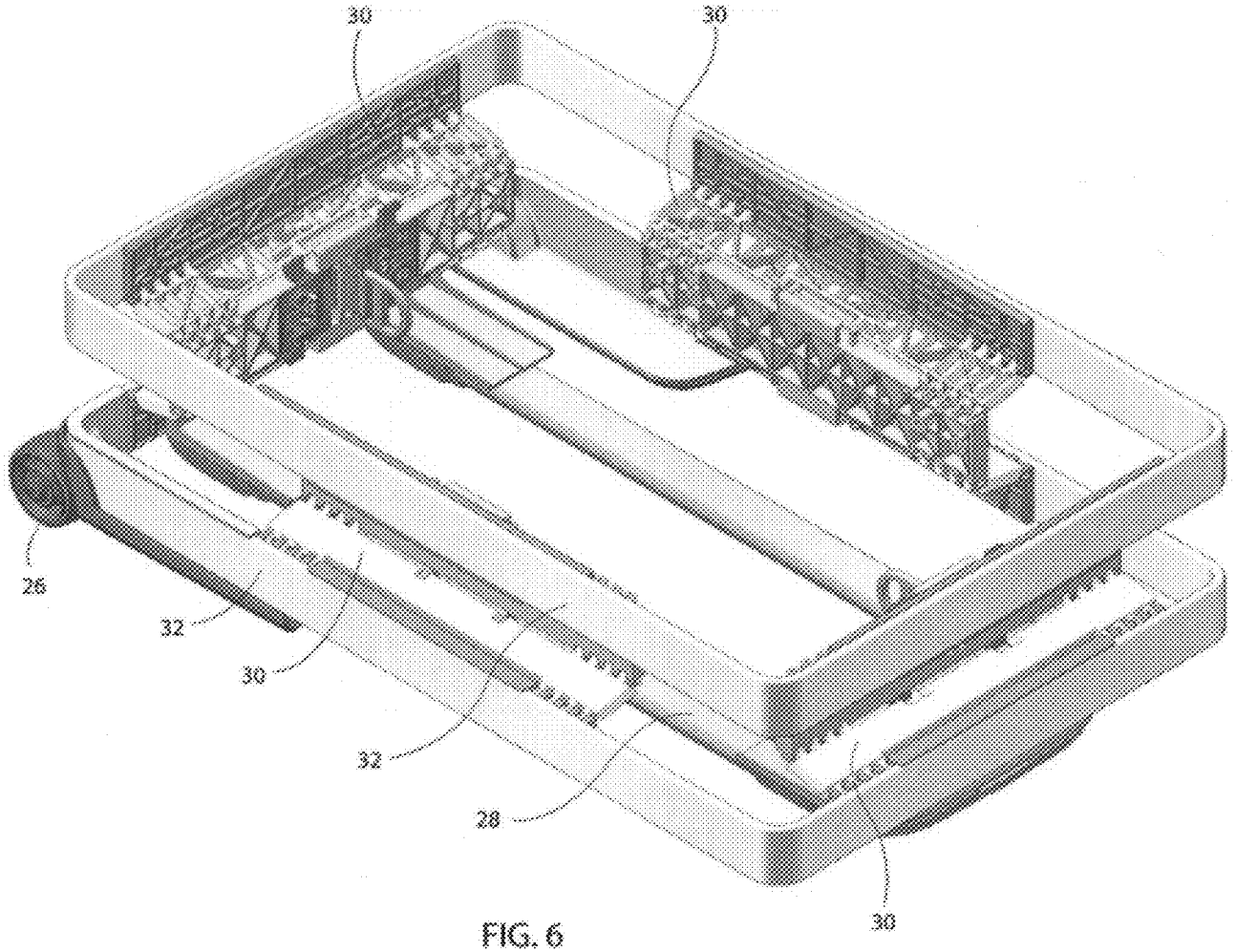
FIG. 6 is a perspective view of the structural components of the baggage shown in FIGS. 1 and 2 and is shown with the baggage and side assemblies between the expanded and collapsed configurations.
Figure 8:
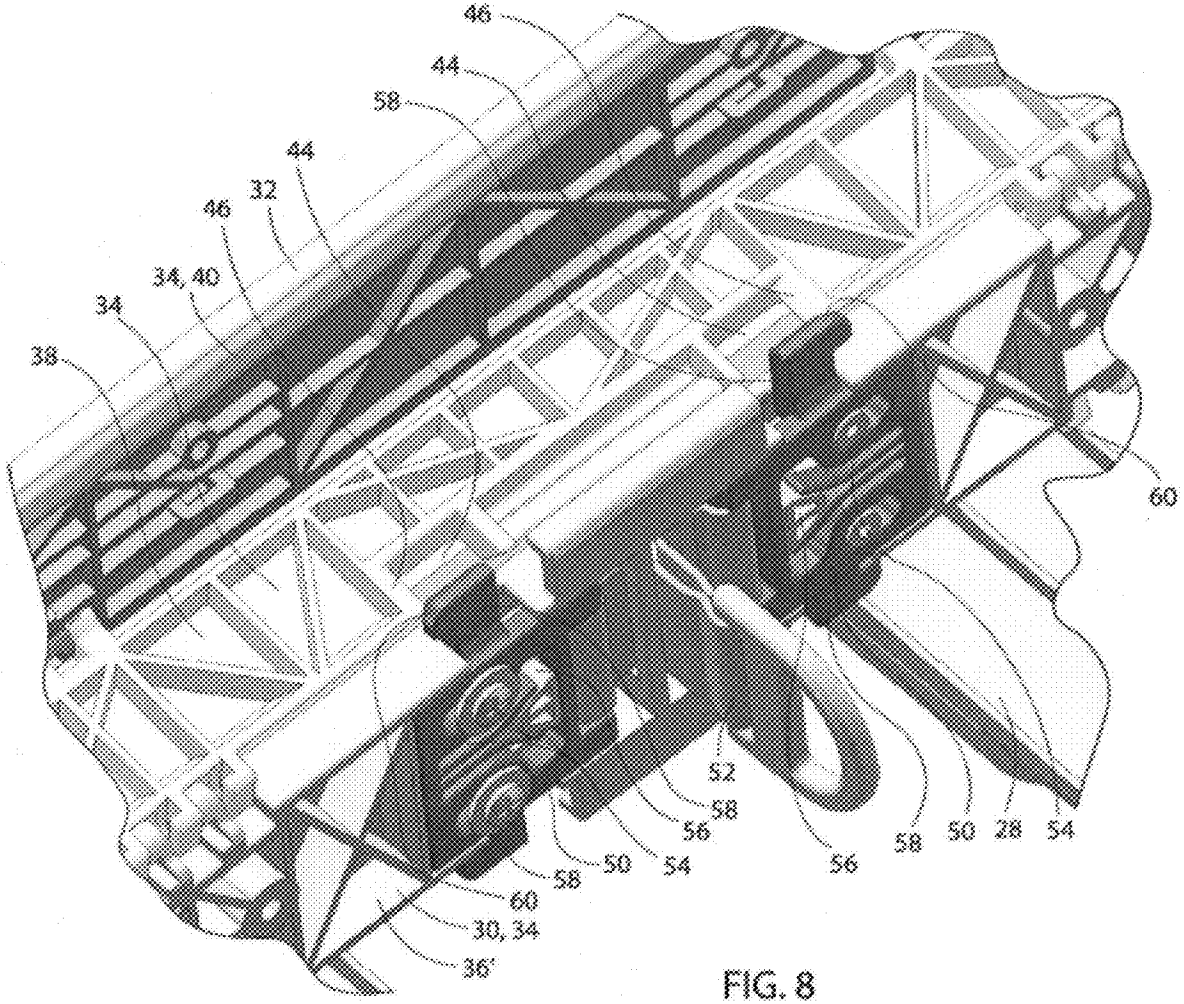
FIG. 8 is a detail perspective view of the side assembly shown in FIG. 5 and is shown between its expanded and collapsed configurations.

The side assemblies 30 shown along the shorter sides of the baggage 20 are very similar to those shown along the longer sides of the baggage. In general these side assemblies 30 are identical to the other side assemblies except that their center panels 36' are slightly different and they further comprise locking members 50 and pull straps 52. As shown in FIGS. 5 and 8, each locking member 50 is preferably slideably attached to the center panel 36' in a manner such the locking member is slideably movable between locking and unlocking positions. Each locking member 50 also preferably comprises resilient tangs 54 that are configured to resiliently deflect against a protuberance 56 provided on the center panel 36' when the locking member moves from the locking position to the unlocking position. This biases the locking member 50 toward its locking position like a spring. Each locking member 50 also comprises a pair of locking protuberances 58 that extend in opposite directions from each other. One side of each locking protuberance 58 comprises a camming surface 60 that is configured to cooperate with the camming surface 46 adjacent one of the receptacles 44 of the adjacent intermediate panel 38 as the side assembly 30 is adjusted to its expanded configuration. As a result, the engagement of the camming surfaces 46, 60 is able to overcome the spring-like nature of the locking member 50 and to thereby automatically move the locking member into its unlocking position as the side assembly 30 is adjusted to its expanded configuration. Once the side assembly 30 is in its expanded position, each locking protuberance 58 is on the opposite side of the respective intermediate panel 38 and the locking member then springs back to its locking position where the lip 48 on each of the receptacles 44 opposite the camming surface 46 then impedes the respective locking protuberance 56 from passing back over to the opposite side of the intermediate panel 38. This locks the side assembly 30 in its expanded configuration in a manner requiring the locking members 50 to be forced toward their unlocking position prior to adjusting the side assembly out of its expanded configuration. To do so, the pull straps 52, which are attached to the locking members 50, are pulled toward the center of the baggage 20. This initially forces the locking members 50 to move to their unlocking positions and thereafter pulls the center panel 36' toward the center of the baggage, thereby causing the side assemblies 30 to which the pull straps are attached to begin to adjust into their collapsed configuration. The other side assemblies can then be collapsed by gently squeezing them toward each other, thereby allowing the entire structure to collapse. It should be appreciated that, as show in FIGS. 1 and 2, the pull straps 52 extend through the inner liner 24 of the baggage 20 so that they are accessible.

Figure 9:
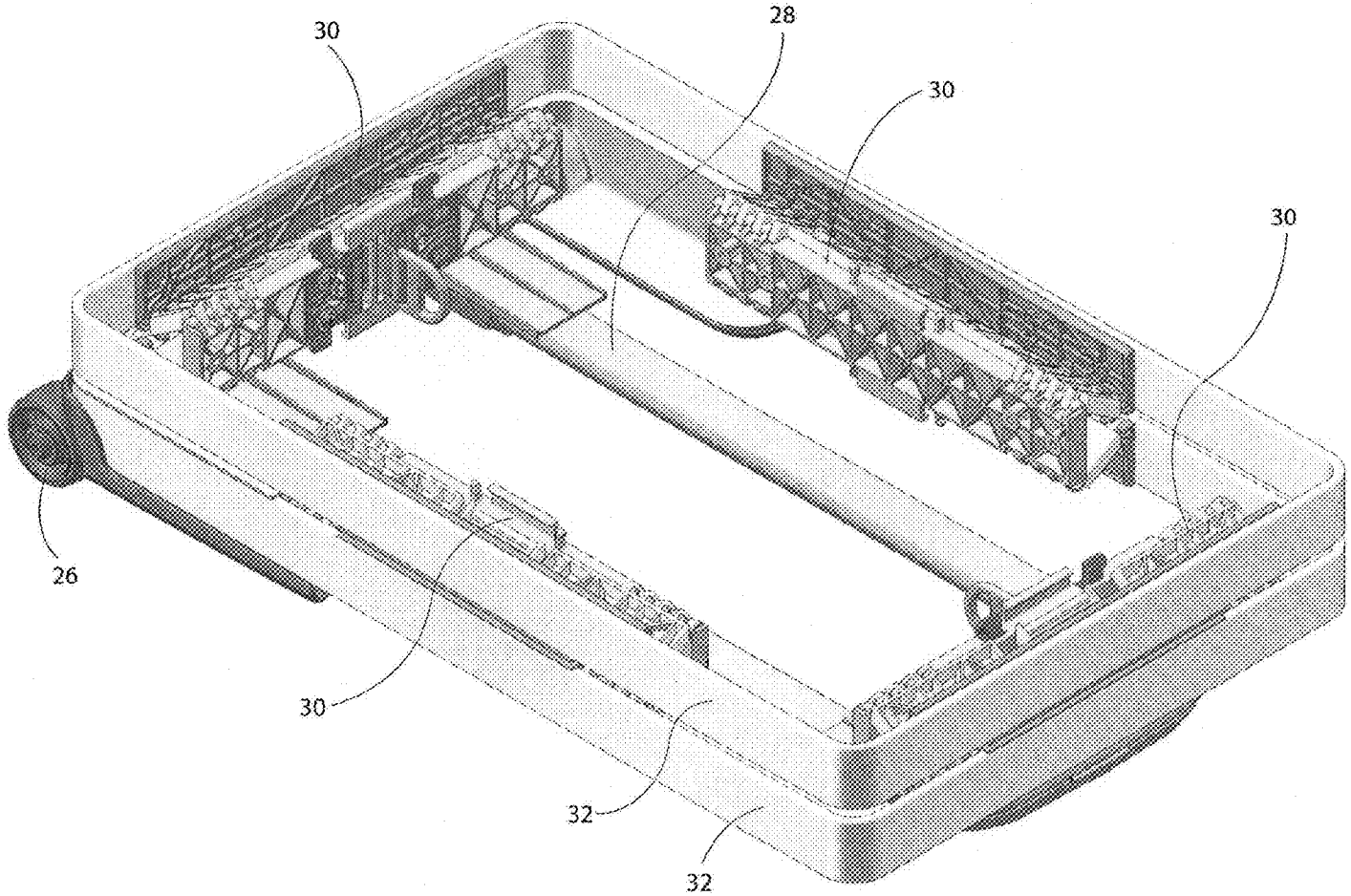
FIG. 9 is a perspective view of the structural components of the baggage shown in FIGS. 1 and 2 and is shown with the baggage and side assemblies in their collapsed configurations.

In addition to the above-mention elements, the baggage 20 also preferably comprises carrying handles 62 (shown only in FIGS. 1 and 2). Each carrying handle 62 is preferably rigidly fixed to one of the center panels 36 of the side assemblies 30. As shown in FIG. 9, the above-described configuration of the side assemblies 30 allows there to be voids between the intermediate panels 38 of each side assembly when the side assemblies are in their collapsed configurations and thereby allows the carrying handles 62 to move into such voids as the baggage 20 is collapsed. This keeps the handles 62 neatly tucked away when the baggage is collapsed and not in use. The baggage 20 can be adjusted from the collapsed configuration to the expanded configuration by initially spreading the perimeter rings 32 slightly apart and thereafter simply simultaneously pulling the carrying handles 62 in opposite directions until the side assemblies 30 lock in their expanded configuration.

In view of the foregoing, it should be appreciated that the side assemblies 30 can be reconfigured from their collapsed configuration to their expanded configuration with relative ease but that reconfiguring them from their expanded configuration to their collapsed configuration requires a deliberate action. This inhibits the side panels 30 from accidently moving out of their expanded configurations. It should also be appreciated that while both the detent locking system and the locking member system are described in reference to the preferred embodiment, a baggage in accordance with the invention need not comprise both systems.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of the preferred embodiment of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed.

What is claimed is:

1. A collapsible baggage comprising:

a structural side assembly, the side assembly comprising first, second, and third rigid panel members, the first panel member being connected to the third panel member via the second panel member, the first panel member being pivotally connected to the second panel member about a first pivot axis, the third panel member being pivotally connected to the second panel member about a second pivot axis, the side assembly being adjustable between collapsed and expanded configurations, the first, second, and third panel members being substantially in plane with each other when the side assembly is in the expanded configuration, the collapsible baggage being configured such that, as the side assembly is adjusted between the collapsed and expanded configurations, the first and third panel members pivot in opposite directions and more than 90 degrees relative to their original position such that a void is formed between the first, second, and third panels when the side assembly is in the collapsed configuration.

2. A collapsible baggage in accordance with claim 1 wherein the baggage comprises a pair of rigid perimeter rings, the side assembly connects one of the perimeter rings to the other of the perimeter rings, the first panel member is pivotally connected to one of the perimeter rings about a third pivot axis and the third panel member is pivotally connected to the other of the perimeter rings about a fourth pivot axis.

3. A collapsible baggage in accordance with claim 2 wherein the side assembly constitutes a first side assembly, and the baggage further comprises second, third, and fourth side assemblies that each connect one of the perimeter rings to the other of the perimeter rings and that each have the claimed limitations of the first side assembly.

4. A collapsible baggage in accordance with claim 1 wherein the side assembly is selectively lockable in the expanded position in a manner such that the side assembly is able to transfer a compressible load from the first panel member to the third panel member.

5. A collapsible baggage in accordance with claim 4 wherein detent elements selectively lock the baggage in the expanded position in a manner such that a torque in excess of a threshold torque most be exerted on the first panel member relative to the third panel member in order to allow to allow the baggage to adjust out of the expanded configuration.

6. A collapsible baggage in accordance with claim 4 wherein the side assembly further comprises a locking member, the locking member is movable between a locking position and an unlocking position relative to the first and second panel members, the locking member inhibits the first and second panel members from pivoting relative to each other when the locking member is in the locking position, the locking member allows pivotal movement of the first panel member relative to the second panel member when the locking member is in the unlocking position, the side assembly is configured such that locking member is biased from the unlocking position toward the locking position in a manner such that locking member automatically moves into the locking position when the side assembly is moved into the expanded configuration, the locking member is configured such the it must be moved into the unlocking position prior to adjusting the side assembly from the expanded configuration to the collapsed configuration.

7. A collapsible baggage in accordance with claim 6 wherein the locking member is slideably connected to the second panel, the locking member inhibits the second and third panel members from pivoting relative to each other when the locking member is in the locking position, and the locking member allows pivotal movement of the second panel member relative to the third panel member when the locking member is in the unlocking position.

8. A collapsible baggage in accordance with claim 1 wherein the collapsible baggage further comprises a handle that is fixed to the second panel member in a manner such that the handle is movable together with the second panel member relative to the first and third panel members, and the handle is positioned within the void when the side assembly is in the collapsed configuration.

9. A collapsible baggage in accordance with claim 8 wherein the collapsible baggage further comprises an inner liner and an outer shell, and the side assembly is position between the inner liner and the outer shell.

10. A method comprising:

adjusting a collapsible baggage, the collapsible baggage comprising a structural side assembly having first, second, and third rigid panel members, the first panel member being connected to the third panel member via the second panel member, the first panel member being pivotally connected to the second panel member about a first pivot axis, the third panel member being pivotally connected to the second panel member about a second pivot axis, the side assembly being adjustable between collapsed and expanded configurations, the first, second, and third panel members being substantially in plane with each other when the side assembly is in the expanded configuration, the collapsible baggage being configured such that, as the side assembly is adjusted between the collapsed and expanded configurations, the first and third panel members pivot in opposite directions and more than 90 degrees relative to their original position such that a void is formed between the first, second, and third panels when the side assembly is in the collapsed configuration, the adjusting of the baggage altering the side assembly from the expanded configuration to the collapsed configuration.

11. A method in accordance with claim 10 wherein the adjusting of the baggage requires a torque in excess of a threshold torque to be exerted on the first panel member relative to the third panel member in order to adjust the side assembly out of the expanded configuration.

12. A method in accordance with claim 10 wherein the side assembly comprises a locking member that is biased from an unlocking position toward a locking position, the locking member inhibits the side assembly from adjusting from the expanded configuration to the collapsed configuration when the locking member is in the locking position, and the adjusting of the baggage comprises forcibly retaining the locking member in the unlocking position while simultaneously adjusting the side assembly out of the expanded configuration.

13. A method in accordance with claim 10 wherein the collapsible baggage further comprises a handle that is fixed to the second panel member in a manner such that the handle is movable together with the second panel member relative to the first and third panel members, and the handle is positioned within the void when the side assembly is in the collapsed configuration.

14. A method in accordance with claim 13 wherein the collapsible baggage further comprises an inner liner and an outer shell, and the side assembly is position between the inner liner and the outer shell.

* * * * *